US005612674A

United States Patent [19]

Tice

[11] Patent Number: 5,612,674

[45] Date of Patent: Mar. 18, 1997

[54] HIGH SENSITIVITY APPARATUS AND METHOD WITH DYNAMIC ADJUSTMENT FOR NOISE

[75] Inventor: Lee D. Tice, Bartlett, Ill.

[73] Assignee: Pittway Corporation, Chicago, Ill.

[21] Appl. No.: 369,424

[22] Filed: Jan. 5, 1995

[51] Int. Cl.[6] ..... G08B 23/00

[52] U.S. Cl. ..... 340/517; 340/501; 340/511; 340/507

[58] Field of Search ..... 340/517, 506, 340/505, 514, 511, 512, 501, 507

[56] References Cited

U.S. PATENT DOCUMENTS 4,785,283 11/1988 Yuchi ..... 340/511

4,916,432 4/1990 Tice et al. ..... 340/505

5,471,194 11/1995 Guscott ..... 340/511

*Primary Examiner*—Donnie L. Crosland

*Attorney, Agent, or Firm*—Dressler, Goldsmith Milnamow & Katz, Ltd.

[57] ABSTRACT

A noise immune detection system includes a plurality of detectors that generate respective indicia representative of adjacent ambient conditions. A communications link extends between the detectors. A control element is coupled to the link to receive and process the indicia and to adjust an alarm threshold level in response to noise levels in the system. Respective indicia are filtered twice by the control element. In the presence of noise, as reflected in relative values of the filtered values of the indicia, the threshold value is automatically increased.

32 Claims, 3 Drawing Sheets

FIG. 4

INITIALIZE — 100

SET a = .001; b= .2

SET |IAI (ADD)| FOR EACH DETECTOR TO BE ADDRESSED

↓

RUNNING — 102

READ $30_n$ (ADD) — 104

IF $|30n(ADD)|$ < SELECTED THRESHOLD $T_1$ — 104a

THEN, INDICATE TROUBLE CONDITION.

↓

SET OFFSET =0

IF $|30_n(ADD)| - |32_n(ADD)| > TEST$ — 106

OR IF $|30_n(ADD)| - |30_{n-1}(ADD) > T_2$ — 108

THEN $30_{n-1}(ADD) = 30_n(ADD)$ AND GO TO IMMEDIATE ALARM

ELSE $32_n(ADD) = (1-a) * 32_{n-1}(ADD) + a * 30_n(ADD)$ — 110

$34_n(ADD) = (1-b) * 34_{n-1}(ADD) + b * [30_n(ADD) - 32n(ADD)]$ — 112

$36_n(ADD) = (1-b) * 36_{n-1}(ADD) + b * 34_n(ADD)$ — 114

IF $|36_n(ADD)| > \frac{IAI(ADD)}{3}$ AND $|36_n(ADD)| > |34_n(ADD)|$ THEN

OFFSET = $|36_n(ADD)| - |34_n(ADD)|$ $32_n(ADD) = 32_n(ADD) + OFFSET$

AND $36_n(ADD) = 34_n(ADD)$ $$PAL_n(ADD) = \frac{36_n(ADD)}{[IAI(ADD)\ \%\ OF\ ALARM]}$$

IF $|PAL(ADD)| > 1$, ALARM

HIGH SENSITIVITY APPARATUS AND METHOD WITH DYNAMIC ADJUSTMENT FOR NOISE

FIELD OF THE INVENTION

The invention pertains to event detection systems. More particularly, the invention pertains to an apparatus and a method which exhibit high noise immunity and can be used for sensing levels of predetermined ambient conditions, such as gases or products of combustion, and for determining when an alarm condition should be indicated.

BACKGROUND OF THE INVENTION

Smoke or fire detection systems have been recognized as useful in enhancing the safety of occupants of large or multiple story buildings where egress from the building, in the event of a fire, might be difficult or dangerous. In such instances, it is desirable to be able to determine as early as possible that a fire or an alarm condition exists. One such system is disclosed in Teach et al. U.S. Pat. No. 4,916,432 assigned to the assignee hereof and incorporated herein by reference.

Counterbalancing the benefits of early detection is a need to guard against transient conditions or noise which might produce undesirable and unacceptable false alarms. For example, if some or all of the detectors are adjusted to have a high sensitivity, false alarms may be generated by electrical noise, cigarette or cooking smoke or the like.

Thus, there continues to be a need for detection or alarm systems which are highly sensitive but exhibit minimal false alarming in the presence of normally expected noise levels. It would be preferred if such systems could dynamically respond to both increasing and decreasing noise levels. Preferably, this result can be achieved without substantial additional expense in either new or existing systems.

SUMMARY OF THE INVENTION

An apparatus which provides a high sensitivity level for a detector in a noisy ambient condition detecting system forms first and second smoothed values associated with a respective detector. These values, in a preferred embodiment, can be compared to adjust a parameter associated with the detector to minimize false alarms due to noise.

The system can include a plurality of spaced apart detectors. The detectors generate respective indicia representative of adjacent ambient conditions.

A communications link is coupled to each of the detectors. A control element is coupled to the link.

The control element includes an apparatus for receiving the indicia and for forming the two smoothed representations of indicia for each of a plurality of detectors. The two smoothed representations can be formed using analog or digital filters.

The control element determines if the second smoothed value is greater than a predetermined percent of a present alarm threshold. If so, and if the second smoothed value is greater than the first smoothed value, a difference is formed.

In one embodiment, the control unit adds the magnitude of the formed difference to a reference value for the respective detector. This in turn increases an alarm threshold for that detector thereby reducing the likelihood that the control unit will generate an alarm condition due to noise.

The control unit compares the second smoothed value to the alarm threshold to determine whether or not the system should go into alarm.

In other embodiments, a magnitude of a formed difference can be added to a threshold value or, alternately, subtracted from one of the smoothed values.

These and other aspects and attributes of the present invention will be discussed with reference to the following drawings and accompanying specification.

BRIEF DESCRIPTION OF THE DRAWINGS

FIG. 4 is a flow diagram of a method in accordance with the present invention.

DETAILED DESCRIPTION OF THE PREFERRED EMBODIMENT

Figure 1:
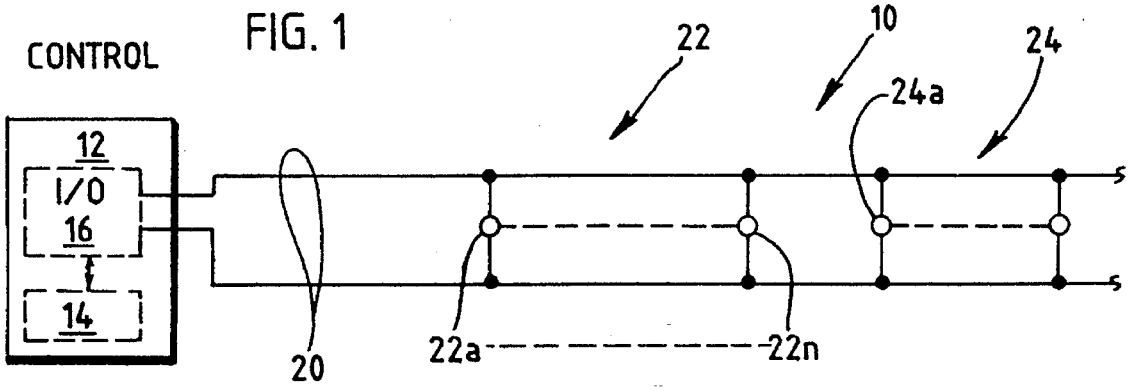
FIG. 1 is a block diagram of a system in accordance with the present invention.

While this invention is susceptible of embodiment in many different forms, there are shown in the drawing, and will be described herein in detail, specific embodiments thereof with the understanding that the present disclosure is to be considered as an exemplification of the principles of the invention and is not intended to limit the invention to the specific embodiments illustrated.

FIG. 1 illustrates a block diagram of a system 10 which embodies the present invention. The system 10 includes a control element 12 which might incorporate a programmable processing unit 14. Alternately, the unit 14 could be implemented using hardwired logic circuits of a type known to those of skill in the art.

The control element 12 includes input/output circuitry 16 which is in turn coupled to a bidirectional communicational link 20. The link 20 can include one or more elongated electrical or optical conductors having various transmission characteristics. It will be understood that the specific details of the communications link 20 are not a limitation of the present invention.

Coupled to the link 20 is a plurality 22 of ambient condition detector units 22*a* through 22*n*. The detector units can be, for example, photoelectric or ionization-type smoke sensors. Alternately, they can be gas detectors, heat detectors or optical flame detectors. It will be understood that the detailed specifics of the detectors 22 are not a limitation of the present invention.

Coupled to the link 20 is a plurality 24 of alarm devices such as horns, bells, strobe lights or the like. The members of the plurality 24, such as alarm indicator 24*a* are under the control of the element 12 and can be energized to provide an audible or visual indication of an alarm condition.

Figure 2:
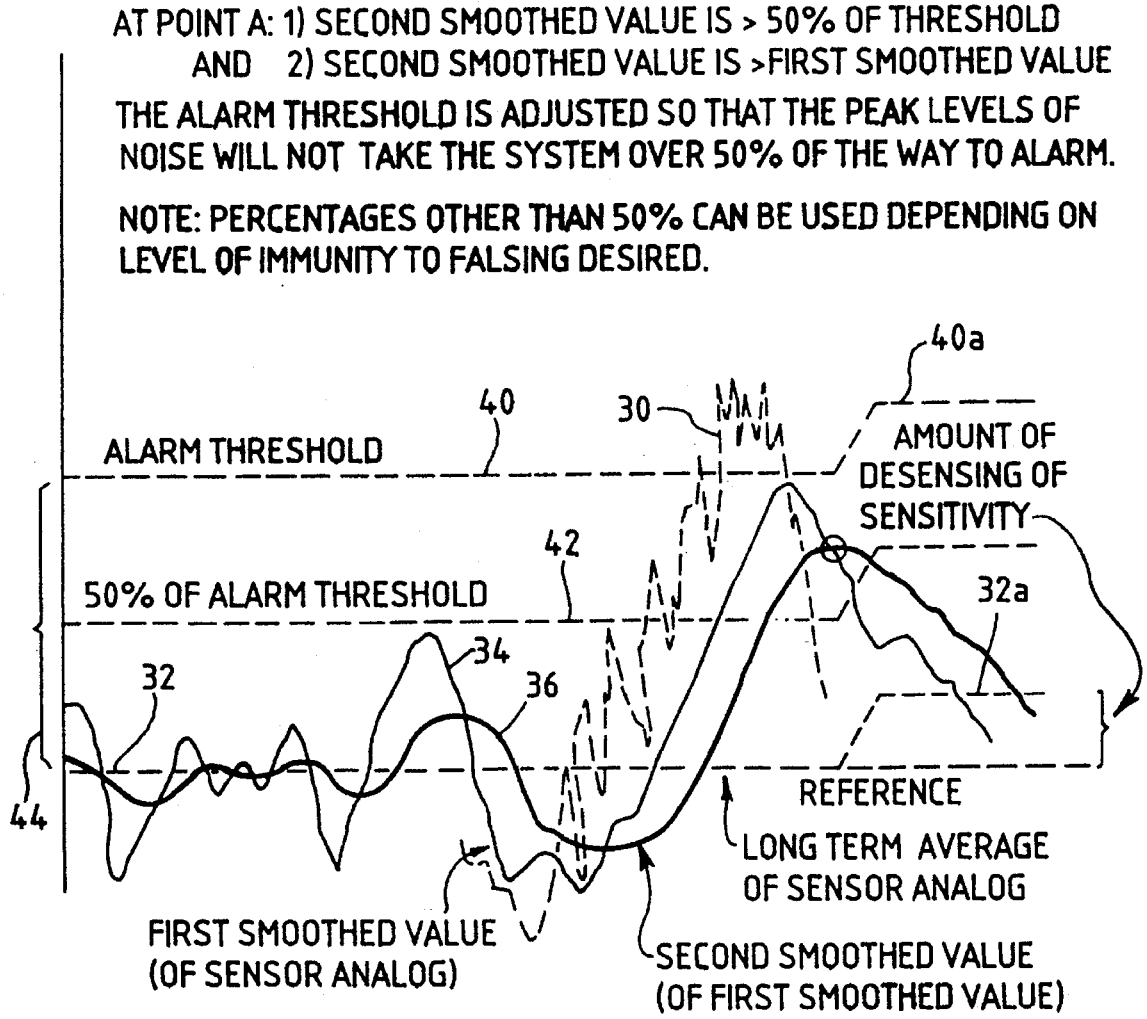
FIG. 2 is a graph which illustrates the response of a representative detector to smoke and associated smoothed values as a function of time.

FIG. 2 is a graph of an analog output 30 of a representative one of the detectors, such as the detector 22*a*, implemented as an ionization-type smoke detector. The output 30 from the representative detector, an ambient condition indicating signal, has been plotted as a function of time. The output 30 illustrates transient levels of an ambient condition, such as smoke, gas concentration, temperature or the like, along with noise which is carried on the ambient condition indicating signal 30.

The output 30 of the representative detector is communicated via the communication link 22, to the control element 12. It will be understood that the signal 30 can be communicated in either an analog or a digital format. The particular format is not a limitation of the present invention.

It will also be understood that the control element 14 can sample the output of a selected detector using a polling technique on a more or less regular basis or by direct addressing. Hence, while the waveform 30 has been drawn as a continuous signal, control element 14 has available to it a plurality of discrete sample values, associated with successive time intervals, for each detector, such as the detector 22*a*.

The control element 12 includes circuitry for processing the discrete values which represent the output 30 and for forming a long term running average 32 thereof. The running average 32 can be calculated using hardwired analog or digital circuitry. Alternately, the long term average 32 can be digitally determined by a programmed method if the unit 14 is a programmable processor.

The long term average, in the case of a relatively low noise system, would normally be expected to be relatively constant. The long term average can be used as a clear air reference value for the respective detector. An average can be formed with respect to a single detector or a group of detectors depending on system characteristics.

The control element 12 includes circuitry for forming a first smoothed or filtered representation 34 of the output 30. The output 30 can be processed in either an exponential analog filter or an exponential digital filter so as to form the first smooth representation 34.

A second smooth representation 36 is formed from the first smoothed representation 34 also using either analog or digital exponential filtering. The second smoothed representation 36 will lag the first smoothed representation 34 where the detector output 30 is increasing.

While for explanatory purposes, the representations 34 and 36 are illustrated in FIG. 2 as continuously varying waveforms, they need not be. For example, representations 34 or 36 could be digitally formed, as discussed subsequently. Hence, only for a single value for each may be available at a given sample time.

Where there is noise present, on the signal 30, the smoothed representations 34 and 36 increase and decrease and can cross one another as illustrated in FIG. 2. The element 12 establishes an alarm threshold 40 for the detector 22*a*. This threshold is displaced an amount 44, the individual alarm increment (IAI), from the average or reference value 32.

The second smoothed representation 36 is, in a preferred embodiment, compared to a predetermined percentage 42 of the alarm threshold, such as 50% of the alarm threshold 42 as illustrated in FIG. 2. Where the second smoothed representation 36 exceeds the predetermined percentage of the alarm threshold 42, a second comparison is then made.

In the second comparison, at time $t_0$, the magnitude of the second smoothed value 36 is compared to the magnitude of the first smoothed value 34. If the magnitude of the second smoothed value 36 is greater than that of the first smoothed value 34, a difference is formed therebetween. Where the two magnitudes are equal, the element 12 repeats the comparison process during a subsequent sample period, at time $t_1$.

In one aspect of the invention, the magnitude of that difference is then added to the reference value 32 to create an increased reference value 32*a* as illustrated in FIG. 2.

Since a predetermined difference 44 is to be maintained between the alarm threshold 40 and the reference value 32, 32*a*, forming an increased reference 32*a* results in an increased alarm threshold 42*a* although the long term average value of the sensor 22*a* may have exhibited a relatively small change. As a result, the sensitivity of the detector 22*a* has effectively been reduced with respect to the noise, but not the ambient condition being detected and exhibited on the detector output 30.

In another aspect of the invention, the magnitude of the difference could be directly added to the alarm threshold 40. Alternatively, that magnitude could be subtracted from the second smoothed representation 36.

To determine whether an alarm condition exists, the processor 14 can compare the second smoothed value 36 to the current value of the alarm threshold 40, 40*a*. The present method and apparatus will desensitize the system 10 in the presence of noise by adjusting a parameter value such that peak values of noise will not cause the smoothed representations of the signal 30 to exceed a pre-determined percent, such as 50%, of the alarm threshold thereby minimizing falsing.

It should be noted that the present approach to establishing an alarm threshold is self-adjusting. Those systems which are relatively quiet and do not exhibit substantial variations about a mean clear-air value, will tend to have a lower alarm threshold. Systems which tend to have a larger amount of noise will have a higher alarm threshold. Thus, the process and method tend to establish an alarm threshold based on current conditions, such that false alarming should be minimized.

Figure 3:
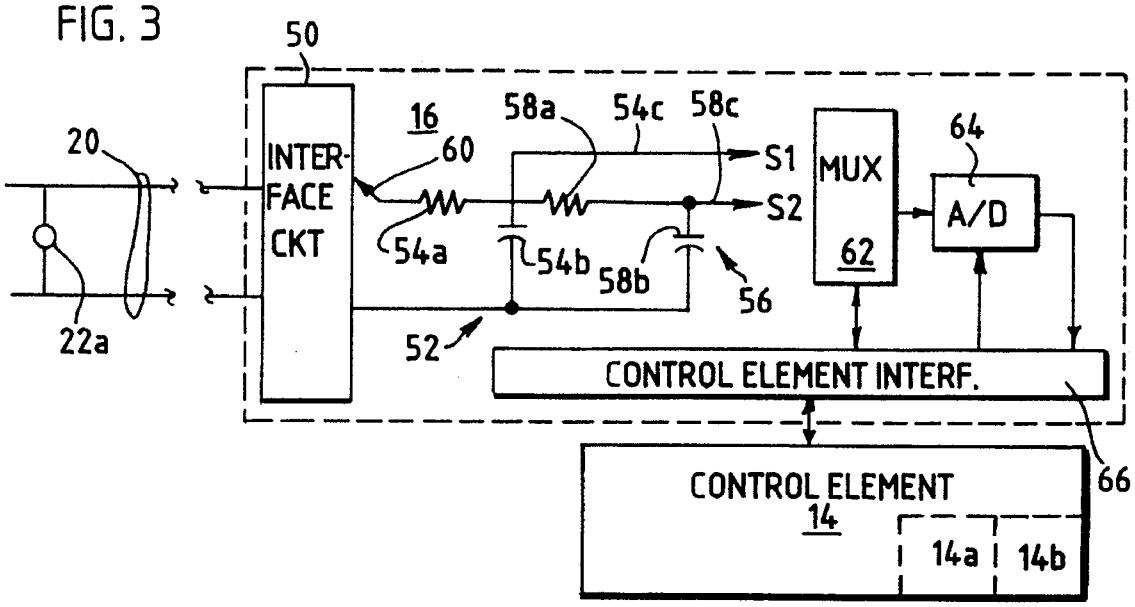
FIG. 3 is a schematic diagram of an analog filter in accordance with the present invention.

FIG. 3 illustrates in schematic block diagram form an embodiment of the system 10 which incorporates hard wired exponential filters to form the representations 34, 36. With reference to FIG. 3, the input/output circuitry 16 includes line interface circuitry 50 which provides line drivers as well as isolation circuitry between the communication link 20 and the remainder of the electronics 16.

The circuitry 16 also includes a first exponential filter 52 formed of a resistor/capacitor combination 54*a*, 54*b*. A second exponential filter 56 is formed of a resistor/capacitor combination 58*a*, 58*b*.

The filter 52 produces the first smoothed output 34 on a line 54*c* when coupled via a switch 60 and communication link 20 to the detector 22*a*. Output from the first exponential filter 52 feeds the second exponential filter 56 which in turn produces the second smoothed output waveform 36, on a line 58*c*. The first and second smoothed waveforms on the lines 54*c*, 58*c*, can be coupled via an analog multiplexer 62 to an analog-to-digital converter 64.

The multiplexer 62 and analog-to-digital converter 64 operate under control of a control element interface 66. The interface 66 provides communication between the I/O circuitry 16 and the control element 14. The control element 14 as noted previously could include a programmable processor, such as processor 14*a* along with associated memory 14*b*.

Digitized representations of a first and second smoothed values 34, 36 can be stored in the memory unit 14*b* under control of the processor 14*a*. Additionally, the magnitude of the long term running average 32, 32*a* can be formed in the processor 14*a* and a representation thereof stored in memory unit 14*b*. The offset 44 between the reference value 32 and the alarm threshold 40, can also be stored in the memory unit 14*b*.

As an alternate to the hardwired filters 52, 56, the first and second smoothed representations can be formed by digital processing. FIG. 4 illustrates a method of digital filtering which embodies the present invention. The method of FIG. 4 can be implemented using the programmable processor 14*a* and associated storage 14*b*.

The control element 14 first initializes constants a, b and sets the individual alarm increment, IAI (add), for each addressable detector in an initialization sequence 100. In a RUNNING sequence 102, the control element 14 addresses a selected sensor, such as 22*a* in a step 104.

The current value of the output of the addressed sensor, $\mathbf{30}_n$ (add), corresponding to signal 30 is then compared to a "low" level to determine if a trouble condition exists in a step 104*a*.

In a step 106, the present output value $\mathbf{30}_n$ for the addressed detector is compared to a threshold, such as the average value 32, to determine if it exceeds a change amount which could occur during TESTING of the sensor. If the sensor is being tested, it will bypass the high sensitivity portion of the present method and alarm immediately.

In order to reduce the impact of fluctuations of output values due to air borne dust, a second lower threshold is used in a step 108 to bypass the high sensitivity method if the difference between the present and previous output values, $\mathbf{30}_n$ and $\mathbf{30}_{n+}$, exceeds a specified amount. This will result in the slowing down an alarm due to a rapid smoke rise detection by 3 samples or less.

The output values $\mathbf{30}_n$ are smoothed in a preferred embodiment using equations that have been formatted so that stored data groups are not required. A current, smoothed average analog value, corresponding to representation 32, that will provide a reference for alarm determination is formed in a step 110.

The differences between the output representation 30 and the reference 32 are smoothed to form the representation 34 in a step 112. Representation 34 is smoothed in a step 114 to form representation 36.

The effect of smoothing representation 34 is to generate a lagging "signal" 36 compared to "signal" 34. Since representation 34 has two smoothing functions performed on it, it responds much less to fluctuations in the value of the output representation 30.

If there is a smoke condition, the output representation 30 of the sensor should continue to rise. Representation 34 will lag the analog values as represented by 30. Representation 36 will lag representation 34 such that signal 34 is always greater than signal 36. When representation 36 exceeds the alarm threshold 40 as illustrated by the individual alarm increment [IAI (add)] as set in the control element 12, an alarm is generated.

As described above, if there is a non-smoke condition, the analog values of the sensor will fluctuate but not continue to rise. Representation 34 will lag the detector value representation 30 and representation 36 will lag representation 34. However, representation 34 will both increase and decrease during the non-fire condition.

When representation 34 decreases, representation 36 will lag this decrease. At some point representation 34 will equal representation 36, a point of zero slope for representation 36. If representation 34 continues to decrease, then representation 36 will become larger than representation 34 and a non-fire condition is recognized.

An increment can then be determined to decrease the sensitivity of the sensor to prevent false alarms. If representation 36 exceeds a predetermined percentage of the alarm threshold 40, then the difference between representation 36 and representation 34 (offset) can be added to the reference 32 and representation 36 set equal to representation 34.

If representation 34 continues to decrease, a difference again occurs between representation 36 and representation 34 and the difference (offset) is again added to the reference and representation 36 set equal to representation 34. This process continues until representation 36 is no longer above a predetermined percentage of the detector's alarm increment [IAI (add)].

The adding of incremental differences between representation 36 and representation 34 to the reference value 32 under the above conditions causes the reference value 32 to increase. The detector output representation 30 then appears to be lower in comparison to the reference value 32.

Representations 34 and 36 will decrease to actual average values less than 0 over time. This decreases the sensitivity of the sensor in that the future change in representation 36 must make up this offset in addition to the individual alarm increment 44. The amount of the offset is thus the amount of decrease in sensitivity.

As a result, a high sensitivity can be established for a detector. If the detector is very quiet, the amount of offset or decrease in sensitivity will be small. Hence, the sensitivity of the detector will be close to the established value. On the other hand, if the noise in the system is high, then the offset will become large and the sensitivity will be decreased substantially to prevent false alarms.

This method is intended to determine a fire condition in the very early stages of a fire before it becomes dangerous. During a fire condition, the detector output values may not increase uniformly.

The amount of lag is determined by the smoothing steps and can be designed to not have any significant decrease in sensitivity due to detector fluctuations during smoke conditions. While, the smoothing will cause a lag in response, a rapid increase in smoke will effectively bypass the high sensitivity method so there will be very little delay in response in this situation.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. An apparatus for detecting a selected condition comprising:

a control element;

a communications link coupled to said element;

an ambient condition detector coupled to said link wherein said detector is capable of communicating indicia representative of a sensed ambient condition to said element and wherein said element includes means for forming a first smoothed representation of said indicia and for forming a second smoothed representation thereof and including means for determining when said second smoothed representation exhibits a zero slope.

2. An apparatus as in claim 1 wherein said control element includes a storage element which contains a threshold value associated with said detector and wherein said control element includes circuitry for altering said threshold value in response to said zero slope.

3. An apparatus as in claim 1 wherein said control element includes a storage element which contains a reference value associated with said detector and wherein said control element includes circuitry for modifying said reference value in response to said zero slope.

4. An apparatus as in claim 3 wherein said control element includes circuitry for comparing a selected representation of said sensed ambient condition to a current threshold value and in response thereto is capable of producing an indicium indicative of a selected condition.

5. An apparatus as in claim 4 which includes an alarm indicating output device, coupled to said control element, for producing an indication of an alarm condition in response to said selected condition indicium.

6. An apparatus as in claim 1 which includes circuitry for reducing values of said second smoothed representation, in response to said determining circuitry, thereby reducing a sensitivity parameter of said detector.

7. An apparatus for detecting a selected condition comprising:

a control element;

a communications link coupled to said element;

an ambient condition detector coupled to communicating indicia representative of a sensed ambient condition to said element and wherein said element includes means for forming a first smoothed representation of said indicia and for forming a second smoothed representation thereof and including means for determining when said second smoothed representation exhibits a zero slope wherein said element includes circuitry for comparing an amplitude value of said first smoothed representation to an amplitude value of said second smoothed representation so as to detect said zero slope.

8. An apparatus as in claim 7 wherein said control element includes a storage element which contains one of an alarm threshold value or a reference value associated with said detector and wherein said control element modifies said one value in response to said zero slope.

9. An apparatus as in claim 8 which includes circuitry for increasing said one value in response to said zero slope.

10. An apparatus as in claim 8 wherein said control element includes arithmetic circuitry for forming a difference between said smoothed representations and wherein said one value is altered in accordance with said difference.

11. An apparatus for detecting a selected condition comprising:

a control element;

a communications link coupled to said element;

an ambient condition detector coupled to communicating indicia representative of a sensed ambient condition to said element and wherein said element includes means for forming a first smoothed representation of said indicia and for forming a second smoothed representation thereof and including means for determining when said second smoothed representation exhibits a zero slope wherein said element includes arithmetic circuitry for forming a difference between said smoothed representations and for altering a selected one of said representations in accordance with said difference.

12. A multiple detector, ambient condition detection system which adjusts a sensitivity parameter of one or more detectors comprising:

at least one ambient condition detector for generating an indicium of a sensed condition;

a communications link coupled to said detector;

a control element coupled to said communications link wherein said element communicates with said detector via said link, wherein said detector is capable of returning to said element indicia representative of an ambient condition and wherein said element includes circuitry for filtering said indicia to produce an output signal and circuitry for filtering said output signal to produce a second output signal, wherein said control element includes circuitry for storing at least one of a reference value and a threshold value and circuitry for comparing a representation of said threshold value with at least said second output signal and for generating a comparison output signal responsive thereto with said control element including further circuitry for detecting when said second output signal exhibits a predetermined parameter value and in response thereto, for modifying one of said threshold value, said reference value, said second output signal.

13. A system as in claim 12 which includes an audible alarm indicator and wherein said indicator is energized to indicate an alarm condition in response to said comparison output signal.

14. A system as in claim 12 wherein said predetermined parameter corresponds to a slope of said second output signal and wherein said detecting circuitry determines when said slope has a zero value.

15. A system as in claim 14 wherein said circuitry increases one of said threshold value or said reference value in response to said slope having said zero value.

16. A system as in claim 14 wherein said circuitry decreases said second output signal in response to said slope having a zero value.

17. A system as in claim 14 wherein said detecting circuitry forms a derivative of said second output value and determines that said derivative has a zero value.

18. A system as in claim 14 wherein said element includes arithmetic circuitry for forming a difference between said representations and wherein said threshold value is modified in accordance therewith.

19. An apparatus as in claim 12 wherein said element includes arithmetic circuitry for forming a difference between said smoothed representations and for altering a selected one of said representations in accordance with said difference.

20. An apparatus for detecting a selected condition comprising:

a control element;

a communications link coupled to said element;

an ambient condition detector coupled to said link wherein said detector is capable of communicating indicia representative of a sensed ambient condition to said element and wherein said element includes means for forming a first smoothed representation of said indicia and for forming a second smoothed representation thereof and including means for determining a difference between said smoothed representations.

21. An apparatus as in claim 20 wherein said control element includes a storage element which contains a threshold value associated with said detector and wherein said control element includes circuitry for altering said threshold value in response to said difference between said second smoothed representation and said first smoothed representation.

22. An apparatus as in claim 20 wherein said control element includes a storage element which contains a reference value associated with said detector and wherein said control element includes circuitry for modifying said reference value in response to said difference between said second smoothed representation and said first smoothed representation.

23. An apparatus as in claim 22 wherein said control element includes circuitry for comparing a selected representation of said sensed ambient condition to a current threshold value for producing, in response thereto, an indicium indicative of a selected condition.

24. An apparatus as in claim 23 which includes an alarm indicating output device, coupled to said control element, for producing an indication of an alarm condition in response to said selected condition indicium.

25. An apparatus as in claim 21 wherein said element includes circuitry to either increase or decrease said threshold value in response to either a positive or negative difference between said first smoothed representation and said second smoothed representation.

26. An apparatus as in claim 22 wherein said element includes circuitry to either increase or decrease said reference value in response to either a positive or negative difference between said first smoothed representation and said second smoothed representation.

27. An apparatus as in claim 20 wherein said smoothing is accomplished by using filtering circuitry.

28. An apparatus as in claim 20 wherein said control element includes a storage element which contains a threshold value and circuitry for forming a value to be subtracted or added to said indicia communicated from the detector in response to the difference between said second smoothed representation and said first smoothed representation.

29. An apparatus for detecting a selected condition comprising:

a control element;

a communications link coupled to said element;

an ambient condition detector coupled to said link wherein said detector is capable of communicating indicia representative of a sensed ambient condition to said element and wherein said element includes means for forming a first smoothed representation of said indicia and for forming a second smoothed representation thereof and including means for determining a difference between said smoothed representations wherein said control element includes arithmetic circuitry for forming said difference between said smoothed representations and wherein a selected value is altered in accordance with said difference.

30. An apparatus for detecting a selected condition comprising:

a control element;

a communications link coupled to said element;

an ambient condition detector coupled to said link wherein said detector is capable of communicating indicia representative of a sensed ambient condition to said element and wherein said element includes means for forming a first smoothed representation of said indicia and for forming a second smoothed representation thereof and including means for determining a difference between said smoothed representations wherein said control element includes a storage element which contains a threshold value associated with said detector and wherein said control element includes circuitry for altering said threshold value in response to said difference between said second smoothed representation and said first smoothed representation wherein said element includes circuitry to reverse said altering of said threshold value in response to said difference between said first smoothed representation and said second smoothed representation.

31. An apparatus for detecting a selected condition comprising:

a control element;

a communications link coupled to said element;

an ambient condition detector coupled to said link wherein said detector is capable of communicating indicia representative of a sensed ambient condition to said element and wherein said element includes means for forming a first smoothed representation of said indicia and for forming a second smoothed representation thereof and including means for determining a difference between said smoothed representations wherein said control element includes a storage element which contains a reference value associated with said detector and wherein said control element includes circuitry for modifying said reference value in response to said difference between said second smoothed representation and said first smoothed representation wherein said element includes circuitry to in reverse said altering of said reference value in response to said difference between said first smoothed representation and said second smoothed representation.

32. A multiple detector, ambient condition detection system which adjusts a sensitivity parameter of one or more detectors comprising:

at least one ambient condition detector for generating an indicium of a sensed condition;

a communications link coupled to said detector;

a control element coupled to said communications link wherein said element communicates with said detector via said link, wherein said detector is capable of returning to said element indicia representative of an ambient condition and wherein said element includes circuitry for filtering said indicia to produce a first output signal and circuitry for filtering said first output signal to produce a second output signal, wherein said control element includes circuitry for storing at least one of a reference value and a threshold value and circuitry for comparing a representation of said threshold value with at least said second output signal and for generating a comparison output signal responsive thereto with said control element including further circuitry for detecting when said second output signal exhibits a predetermined parameter value and in response thereto, for modifying one of said threshold value, said reference value said second output signal.

* * * * *

UNITED STATES PATENT AND TRADEMARK OFFICE

CERTIFICATE OF CORRECTION

PATENT NO. : 5,612,674

DATED : March 18, 1997

INVENTOR(S) : Lee D. Tice

It is certified that error appears in the above-indentified patent and that said Letters Patent is hereby corrected as shown below:

Column 10, line 2, delete [threshold] and insert --reference--.

Column 10, line 4, delete [altering] and insert --modifying--.

Column 10, line 4, delete [threshold] and insert --reference--.

Column 10, line 25 delete [reference] and insert --threshold--.

Column 10, line 27, delete [reference] and insert --threshold--.

Column 10, line 31, delete [reference] and insert --threshold--.

Signed and Sealed this

Second Day of September, 1997

*Attest:*

*Attesting Officer*

BRUCE LEHMAN

*Commissioner of Patents and Trademarks*